US008413564B1

(12) United States Patent
Genovese et al.

(10) Patent No.: US 8,413,564 B1
(45) Date of Patent: Apr. 9, 2013

(54) PORTABLE VENTED SUPPRESSIVE SHIELD FOR PROTECTIVE TACTICAL EMPLACEMENT OVER SUSPECTED EXPLOSIVE DEVICES

(75) Inventors: James A. Genovese, Street, MD (US); Stephen J. Comaty, Bel Air, MD (US); Edward M. Rychwalski, Bel Air, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 784 days.

(21) Appl. No.: 12/569,379

(22) Filed: Sep. 29, 2009

(51) Int. Cl.
*F42D 5/00* (2006.01)
*E06B 5/12* (2006.01)

(52) U.S. Cl. ..... 86/50; 102/303; 109/49.5

(58) Field of Classification Search ..... 86/50; 89/36.01, 89/36.07, 36.09; 220/88.1, 88.2, 560.01, 220/4.26, 4.04, 4.08, 4.09, 4.28, 4.33, 4.34; 404/25, 26; 109/11, 12, 26, 49.5; 102/303
See application file for complete search history.

(56) References Cited

U.S. PATENT DOCUMENTS

| | | | | |
|---|---|---|---|---|
| 537,182 | A * | 4/1895 | Brown | 220/3.7 |
| 813,365 | A * | 2/1906 | Dreyer | 220/88.2 |
| 1,134,838 | A * | 4/1915 | Gaumer | 220/88.2 |
| 2,220,720 | A * | 11/1940 | Jett | 220/88.2 |
| 4,889,258 | A * | 12/1989 | Yerushalmi | 220/560.01 |
| 5,248,055 | A * | 9/1993 | Sanai et al. | 220/327 |
| 6,595,247 | B1 * | 7/2003 | Landy et al. | 141/97 |
| 7,281,309 | B2 * | 10/2007 | Reynolds | 29/455.1 |
| 7,490,537 | B1 * | 2/2009 | Vande Brake | 86/50 |
| 7,819,049 | B2 * | 10/2010 | Pastrnak et al. | 89/36.09 |
| 8,156,708 | B2 * | 4/2012 | Moore et al. | 52/741.3 |
| 2005/0279204 | A1 * | 12/2005 | Bishop et al. | 86/50 |
| 2006/0096451 | A1 * | 5/2006 | Laubie | 89/36.07 |
| 2007/0039453 | A1 * | 2/2007 | Toycen et al. | 86/50 |
| 2007/0119851 | A1 * | 5/2007 | James | 220/88.1 |
| 2011/0303676 | A1 * | 12/2011 | Day | 220/560.01 |

* cited by examiner

*Primary Examiner* — Michael Carone
*Assistant Examiner* — Reginald Tillman, Jr.
(74) *Attorney, Agent, or Firm* — Ulysses John Biffoni

(57) ABSTRACT

A portable protective shield for an IED or other suspected explosive devices includes a plurality of toroidal rings clamped between a lid and a base of the shield. The device is capable of withstanding high-pressure blast waves, thermal release and/or high-velocity fragments.

16 Claims, 4 Drawing Sheets

PORTABLE VENTED SUPPRESSIVE SHIELD FOR PROTECTIVE TACTICAL EMPLACEMENT OVER SUSPECTED EXPLOSIVE DEVICES

GOVERNMENT INTEREST

The invention described herein may be manufactured, used, and licensed by or for the U.S. Government.

FIELD OF THE INVENTION

The present invention relates to a portable vented suppressive shielding device ("VSS') that can be emplaced over a suspected explosive ordnance such as an Improvised Explosive Device ("IED") and, more particularly, to a system to protect persons or equipment from the effects of an explosive detonation, such as the mechanical shock wave, heat, flames and/or high velocity fragments.

BACKGROUND OF THE INVENTION

The use of certain types of suppressive shielding for the containment of explosive blasts is well known. For example, vented blasting mats have long been used in quarry operations to confine detonation effects. The design of such mats was primarily achieved through trial and error. More recently, the application of suppressive shielding has been considered for use in other commercial and military applications.

In military applications, suppressive shielding developments have been generally directed towards the containment of an IED within a shielding. The blast, fragments and/or fireball which accompany such a contained explosive—as for example, the detonation of a round used as a large caliber weapon—can be considered a worst case test for a shielding container.

An explosive suppressive shielding has many important applications. For example, such shielding can be used in transportation terminals, such as airports and bus stations where terrorist attacks can occur. The shields may take many forms in such an application. For instance, a suppressive shielding container may be placed over a suspected explosive device at baggage checkpoints. Such a shielding container may also be placed on an aircraft over a suspected explosive device until proper evacuation of the passengers and crew.

Naturally, applications for such a shield are not limited to airports and other transportation facilities. In an industrial plant, for example, equipment subject to explosion may be surrounded by a suppressive shield in order to protect workers in the vicinity.

Obviously, such vented suppressive shielding also has important military applications. Explosive devices may be stored within a shielded container or larger shields may be used to surround explosive storage areas. Such a shielding barrier requires that the shield has the ability to withstand not only high pressure waves and a thermal release (fireball) but also high velocity fragments (shrapnel) that invariably are part of military munition fragments after detonation.

The problems of providing a useful suppressive shielding are many. Concrete revetments/walls and steel shelters can often provide sufficient shielding, but are too bulky and heavy to provide the various types of protection mentioned above. Such shields often inhibit movement of people or machines because of their large size. Also, the construction of portable shields of these materials is not possible because of their excessive weight and bulk.

Because of the abovementioned there has been a need for a suppressive shielding which is relatively light and not bulky, but which still provides sufficient protection from the blast pressure, heat, flame and fragments which may accompany an explosion. In many cases, IEDs are found in locations where large/heavy blast systems are not tactically deployable or effective.

It would be very beneficial generally—and to the military specifically—to provide a shield for an IED or other explosives; which is compact and readily portable, practical and relatively low-cost, easily produced and/or assembled out in the field, and capable of sustaining high-pressure blast waves, thermal releases and/or high-velocity shrapnel or other fragments.

SUMMARY OF THE INVENTION

Accordingly, it is an object of the present invention to provide a shield which readily meets the objectives listed above.

In accordance with the teachings of the present invention, a preferred embodiment thereof is herein disclosed, which comprises a portable, vented suppressive shield for protective tactical emplacement over a suspected explosive device. This shield includes a base having an opening adapted to surround the explosive device. A plurality of rings are stacked one on top of another above the base. A lid is disposed on top of the stack of rings, the lid being provided with vent openings. Fastening means secures the lid to the base and clamps the stack of rings therebetween, such that the shield has the ability to withstand high-pressure blast waves, a thermal release, and/or high-velocity fragments.

In a one embodiment, the stack of rings includes a plurality of first and second rings, respectively, stacked vertically and alternately with respect to each other, such that each second ring is nested radially inwardly of a corresponding first ring, and such that the alternate stacking provides a tortuous path for dissipation of the mechanical shock waves generated by the explosion.

In a preferred embodiment, a third set of rings is employed.

Preferably, the base has an external annular trepan formed thereon, and the rings includes a lowermost ring which is received within the trepan on the base.

Preferably, each ring is tubular and is welded together end-to-end to form welding junctions.

The rings may be hollow or made of a relatively heavy-gage metal, or made of a relatively lower-weight composite forming a polymeric barrier that encases a steel cable, or any combination thereof. The shield itself may be filled with foam to attenuate mechanical waves.

In a preferred embodiment, the lid is domed and is provided with a plurality of spaced-apart arcuately-formed vent openings, providing a tortuous path for rapidly dissipating the shock waves. The lid may be provided with a pair of handles for convenient manual portability.

Preferably, the fastening means comprises a plurality of circumferentially-spaced bolts disposed radially of the stack of rings; the bolts pass through respective openings in a radial flange on the lid and are received in respective tapped recesses in the base.

Viewed in another aspect, the present invention provides a protective shield for an explosive device, wherein the shield includes a base, a lid, and a plurality of wall sections disposed therebetween. The wall sections are stacked vertically and are spaced apart sufficiently to provide a tortuous path for the gases generated by an implosion of the device.

Preferably, the wall sections comprise respective sets of rings spaced apart, vertically, sufficient to accommodate maximum acceptable pressure limits.

These and other objects of the present invention will become apparent from a reading of the following specification taken in conjunction with the enclosed drawings.

GENERAL DESCRIPTION OF THE PREFERRED EMBODIMENTS

Figure 1:
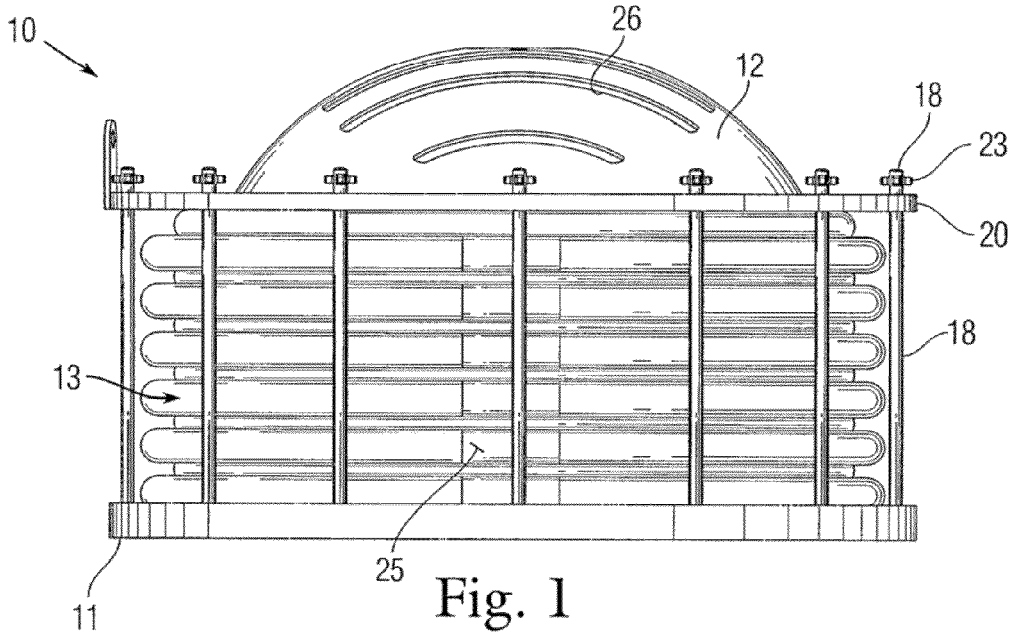
FIG. 1 is a front elevation of the shield of the present invention, showing the stack of tubular rings clamped between the base and the lid of the shield by means of a plurality of circumferentially-spaced bolts disposed radially of the stack of circular rings.
Figure 2:
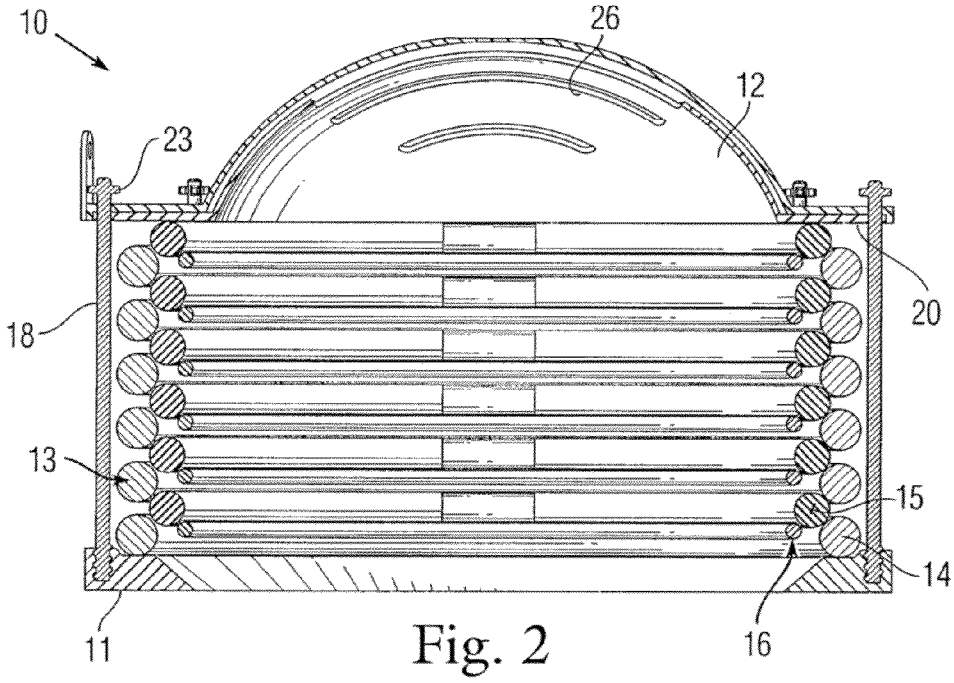
FIG. 2 is a longitudinal cross-sectional view thereof with certain parts shown in section and in elevation, respectively.
Figure 4:
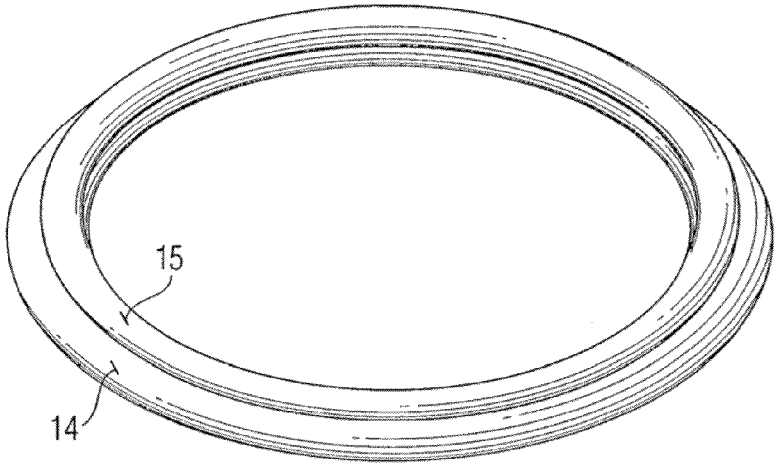
FIG. 4 is a perspective view of a smaller diameter ring nested within a larger diameter ring (the base being omitted in this view for clarity of understanding).

With reference to FIGS. 1 and 2, the shield 10 includes a base 11, a lid 12, and a stack 13 of rings (comprising wall sections) disposed therebetween. This stack of rings 13 includes a first plurality of rings 14, a second plurality of rings 15 and (preferably) a third plurality of rings 16. The rings 14 are of greater diameter (and cross-sectional thickness) then the rings 15 which, in turn, are greater than the rings 16; and the rings 14, 15 and 16 are nested within each other (see FIG. 4) and are alternately stacked, vertically, as shown more clearly in FIG. 2, to form the stack 13.

This preferred alternate stacking arrangement provides a tortuous path for the escaping gases and contributes to the efficient performance of the shield 10. However, other stacking arrangements are equally applicable in accordance with the teachings of the present invention.

Figure 3:
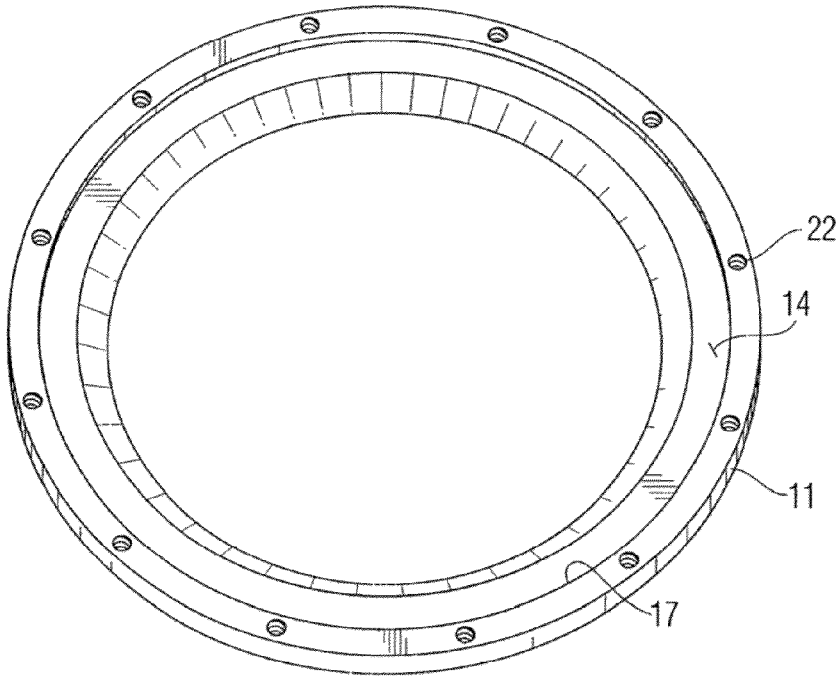
FIG. 3 is a perspective view of the base of the shield.

With reference to FIG. 3, the base 11 has an annular trepan 17 formed therein, and a lowermost one of the first plurality of rings 14 is disposed therein.

Figure 5:
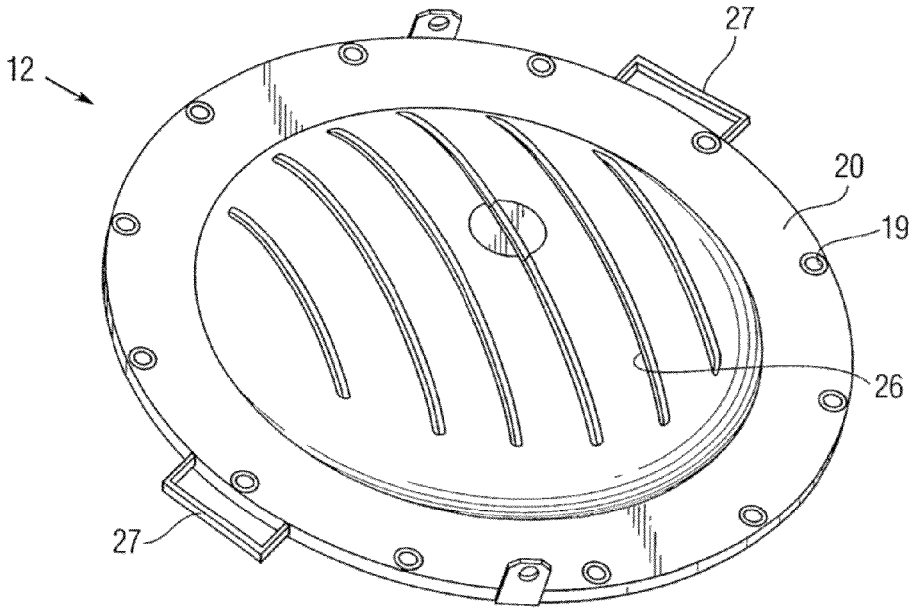
FIG. 5 is a perspective view of the domed lid, showing the plurality of spaced-apart arcuate vents formed therein.
Figure 6:
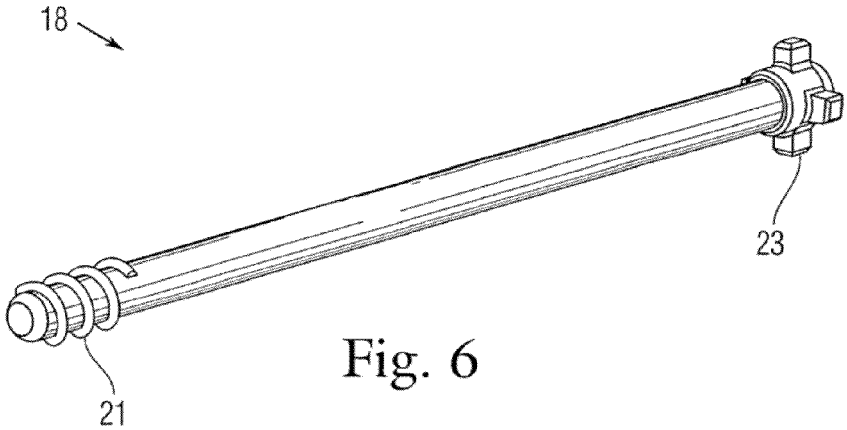
FIG. 6 is a perspective view of one of the bolts for retaining the stack of tubular rings between the lid and the base of the shield.

With reference again to FIGS. 1 and 2, and with further reference to FIGS. 5 and 6, a plurality of bolts 18 (or other suitable fastening means) clamps the stack 13 between the base 11 and the lid 12.

The bolts 18 pass through respective openings 19 formed in a radial flange 20 on the lid 12, and each bolt 18 is provided with threads 21 which are received in respective tapped recesses 22 formed in the base 11. The bolts 18 are circumferentially spaced and are disposed radially of the stack 13 of rings 14-16. Preferably (see FIG. 6) each bolt 18 is provided with a plurality of protruding grips 23 for convenient manipulation and tightening of the bolts 18, manually, and with or without a suitable tool (not shown).

Figure 7:
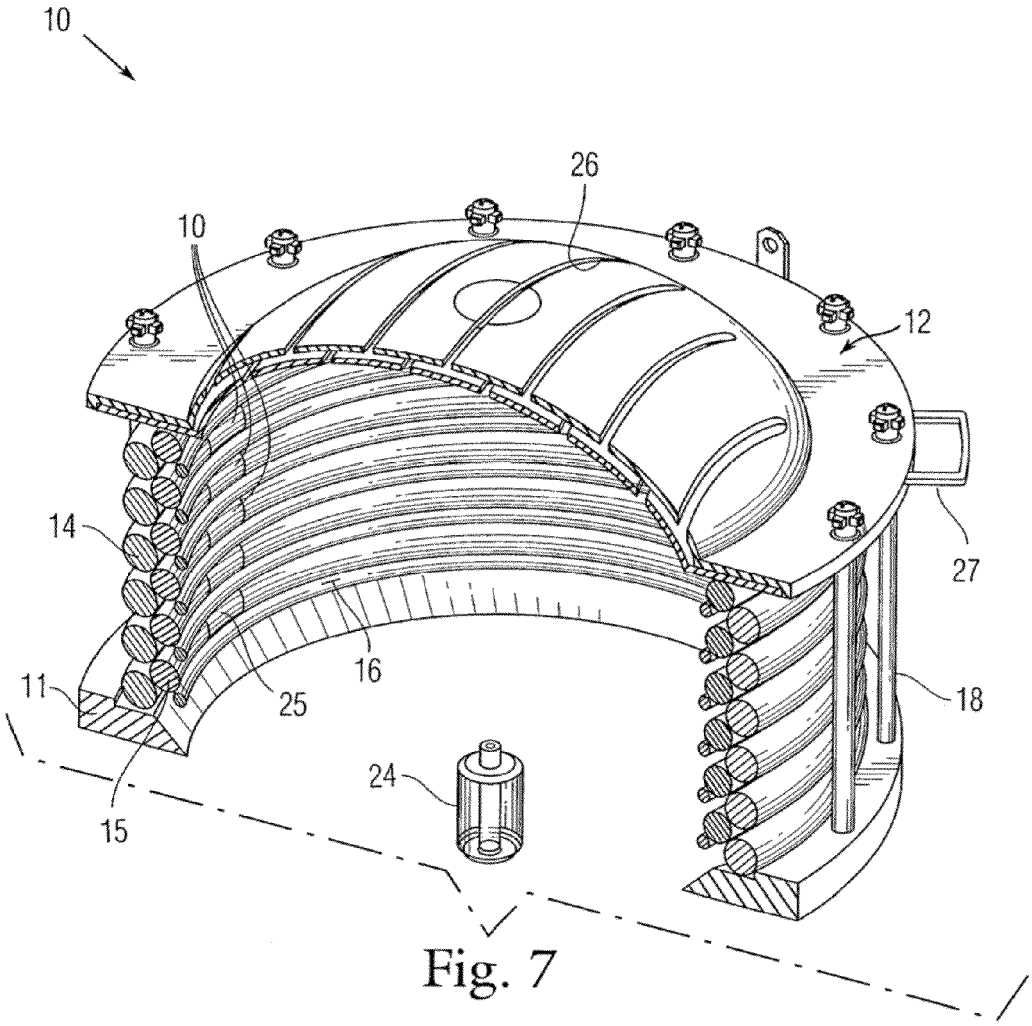
FIG. 7 is a further perspective view of the shield of the present invention, but cut-away and sectioned to illustrate how the shield encompasses an IED.

With reference to FIG. 7, the shield 10 encompasses the explosive device, such as an improvised explosive device (IED) 24.

In the preferred embodiment, and viewed in another aspect, the shield 10 comprises a plurality of interlocking hollow toroidal rings (14-16), which are placed one at a time over the IED 24 (or other suspected item) to form the stack 13 of rings on top of the base 11. Those tubular shielding components are relatively lightweight and, as appreciated by one skilled in the art, provide a tortuous path shielding barrier, when interlocked with the bolt framing components. This shielding barrier comprises a plurality of attached pipes and/or rods in a discrete tortuous conformation which, when stacked one on top the other, create a tortuous vented path leading away from the explodable device 24. This unique design affords a path of explosive by-products which removes energy from the explosion gases as they expand outwardly, mitigating blast over pressure. Additionally, this construction captures high velocity fragments and reduces the fireballs heat energy.

The tubular toroidal components (in the stack 13 of rings) are circularly bent and connected through a welded junction 25 that serves as its coupling. The respective welded junctions 25 can also provide a raised section in the stack 13 that allows for customized vented spacing when stacked vertically and aligned circumferentially with respect to each other (as shown in FIG. 7) and the rings 14 and 16 may be welded to the coupling (welded junction) 25. The bolts 18 surround the wall barrier pieces such that they are free to move in the space defined to them, relative to the limitations of the bolts 18.

The lid 12 has its own tortuous vented pathway, comprising a plurality of spaced-apart arcuate openings 26 formed therein. The lid 12 is further provided with respective handles 27 for convenient portability.

Several additional steps may be taken to improve the performance of the shield 10. First, the shield 10 can be bolted to the ground, if possible, to help prevent it from being lifted up during an explosion when the reflective wave properties of the device are most important. Second, sandbags may be placed on top of the shield 10 to add more mass to the system, reducing the explosions ability to move the structure. Also, conventional aqueous foam (not shown) could be injected into the cavity created by the vertically-stacked rings 13 of the shield 10 to further mitigate the expansion of the gases from the explosion. It is known that applications of aqueous foam or explosion blast foam technology with expansion ratios of 50 or 100 to 1 will significantly lower blast overpressure.

With respect to the methodology involved in setting up the shield 10, there are basically three situations. All follow the same basic steps, but they differ in their order and where the shield 10 is set up in relation to the explosive device 24. In the first scenario, the shield 10 is assembled away from the explosive device 24; the lid 12 is not put in place; the IED 24 is placed within the shield 10 and the lid 12 is then attached. In these specific cases standard "Render Safe Procedures" (RSP's) are adhered to before the lid 12 is attached.

In the second case, the shield 10 is completely assembled away from the explosive device 24, and is then placed overtop the explosive device 24. These first two methods are preferred because they minimize the operator time on target.

In the third situation, the base for the shield 10 is placed around the IED 24, and the shield 10 is built up around it. Standard containment measures are applied accordingly.

To set up the shield 10, first the base 11 is set on level ground. In a preferred embodiment, the base 11 is roughly three (3) feet in diameter. There is an annular recess/or groove (trepan 17) for the lowermost one of the first rings 14 that make up the walls of the shield. The wall pieces (rings of the stack 13) are stacked on the base 11, starting in trepan 17, one on top of the other. For greater spacing between the wall pieces, the welded junctions (couplings) 25 can be stacked, thereby alleviating excessive blast pressures. The lid 12 is placed onto the stack 13 of ring wall sections (up to roughly two (2) feet above the ground in a preferred embodiment). The bolts 18 are then inserted thorough the holes (openings) 19 in the flange 20 on the lid 12 and screwed securely into their respective tapped recesses 22 in the base 11. The lid 12 can be carried by its handles 27. This will create the multi-component system (depicted herein) which is ready to diminish the damage an explosive device 24 could cause.

As will be appreciated by one skilled in the art, the respective sets of vertically-spaced rings 14-16 are stacked sufficiently to accommodate maximum acceptable pressure limits.

By maximum acceptable pressure limit, we are referring to that peak blast pressure which the VSS (shield 10) can contain without sacrificing its operational purposes (namely, running the hazards produced during an explosion. In the present invention, additional wall sections may be added to the structure which will increase its internal volume, as well as the venting, both of which will increase the maximum acceptable pressure limit. By increasing the amount of surface area (increased venting) through which the blast wave can travel, the pressure build-up within the VSS (shield 10) may be diminished, thus enabling the shield 10 to contain larger peak blast pressure.

Additionally, the VSS (shield 10) relies on its mass to keep it in contact with the surface upon which the VSS is assembled. The VSS should have sufficient mass to prevent the VSS from lifting off the surface upon an explosion, thereby avoiding blast energy from escaping under a newly-created gap.

The welded junction 25 provides the desired static spacing between each ring of a wall section (wherein the rings are welded together). The welded junctions may be stacked one on top of the other (and circumferentially aligned) or in an offset manner. When stacked offset, a small area is produced between adjacent wall sections ("sister" rings) thereby contributing to the tortuous pathway. When stacked one on top of the other, the larger spacing will reduce the peak pressure in the VSS (shield 10) thus allowing it to contain larger blasts. This structural flexibility of the shield 10 is yet another desirable feature of the present invention.

As appreciated by those skilled in the art, the present invention substantially improves upon the prior art by providing a practical portable shielding device. The individual elements are comprised of a lightweight, yet sturdy metal. When assembled, the components form a solid system able to reduce the damage that would be caused by an explosive device. The system is man deployable; one or two individuals are able to set up the system in a matter of minutes. Furthermore, such as with multi-story buildings, it is easy to place in difficult locations due to its inherent compact size.

The components of the barrier may be made from heavy gauge aluminum or steel, or even an integrated lower weight composite consisting of a polymeric barrier that encases large diameter welded steel cable, as may be desirable in a particular application. Such components could be lighter in weight than materials such as steel or concrete.

Obviously, many modifications may be made without departing from the basic spirit of the present invention. Accordingly, it will be appreciated by those skilled in the art that within the scope of the appended claims, the invention may be practiced other than has been specifically described herein.

The invention claimed is:

1. A portable, vented suppressive shield for protective tactical emplacement over a suspected explosive device, comprising a base haying an opening adapted to surround the explosive device, a plurality of rings stacked one on top of another above the base, wherein the stack of rings includes a plurality of first and second rings, respectively, alternately stacked vertically with respect to each other, such that each second ring is nested radially inwardly of a corresponding first ring, and such that the alternate stacking is repeated, a lid on top of the stack of rings, and fastening means securing the lid to the base and damping the stack of rings therebetween, such that the shield has the ability to withstand high-pressure blast waves, a thermal release, and/or high-velocity fragments.

2. The shield of claim 1, wherein the base has an external annular trepan formed thereon, and wherein the plurality of first in includes a lowermost ring received within the trepan on the base.

3. The shield of claim 1, wherein each ring is tubular and welded together end-to-end to form welded junctions.

4. The shield of claim 3, wherein the welded junctions are stacked vertically to provide a spacial difference, thereby forming a cavity between the rings and a tortuous pathway for the blast waves.

5. The shield of claim 4, wherein the cavity is filled with an aqueous foam.

6. The shield of claim 3, wherein each ring is hollow.

7. The shield of claim 6, wherein each ring is made of a relatively heavy-gage metal.

8. The shield of claim 3, wherein each ring is made of a relatively lower-weight composite forming a polymeric barrier that encases a steel cable.

9. The shield of claim 1, further including a plurality of third rings nested radially inwardly within the plurality of second rings.

10. The shield of claim 1, wherein the lid is domed and is provided with a plurality of spaced-apart arcuately-formed vent openings.

11. The shield of claim 10, further including a pair of handles on the lid.

12. The shield of claim 1, wherein the fastening means comprises a plurality of circumferentially-spaced bolts disposed radially of the stack of rings.

13. The shield of claim 9, wherein each third ring is welded to a corresponding welded junction.

14. The shield of claim 1, wherein said plurality of rings comprises at least two sets of rings, including a first set of rings having a larger diameter than the second set of rings, the outer diameter (OD) of the second set of rings being slightly greater than the inner diameter (ID) of the first set of rings such that the vertical stacking arrangement provides a tortuous path for the gases generated by an explosion.

15. The shield of claim 14, further including at least a third set of rings nesting within said second set of rings.

16. The protective shield of claim 14, wherein each ring includes an integral respective portion, and wherein the respective integral portions are aligned circumferentially.

* * * * *